US007926578B2

(12) United States Patent
Moffitt et al.

(10) Patent No.: US 7,926,578 B2
(45) Date of Patent: Apr. 19, 2011

(54) LINER DRILLING SYSTEM AND METHOD OF LINER DRILLING WITH RETRIEVABLE BOTTOM HOLE ASSEMBLY

(75) Inventors: Michael E. Moffitt, Houston, TX (US); Michael Brouse, Houston, TX (US)

(73) Assignee: Tesco Corporation, Houston, TX (US)

( * ) Notice: Subject to any disclaimer, the term of this patent is extended or adjusted under 35 U.S.C. 154(b) by 155 days.

(21) Appl. No.: 12/347,610

(22) Filed: Dec. 31, 2008

(65) Prior Publication Data

US 2009/0101345 A1 Apr. 23, 2009

Related U.S. Application Data

(63) Continuation-in-part of application No. 12/238,191, filed on Sep. 25, 2008, now Pat. No. 7,784,552.

(51) Int. Cl.
*E21B 19/16* (2006.01)

(52) U.S. Cl. ..... 166/380; 175/171

(58) Field of Classification Search ..... 175/171; 166/380, 287, 242.3

See application file for complete search history.

(56) References Cited

U.S. PATENT DOCUMENTS

| | | | |
|---|---|---|---|
| 3,163,238 | A | 12/1964 | Malott |
| 5,074,366 | A | 12/1991 | Karlsson et al. |
| 5,425,423 | A | 6/1995 | Dobson et al. |
| 5,957,225 | A | 9/1999 | Sinor |
| 6,095,261 | A | 8/2000 | Trevino, Jr. |
| 6,138,774 | A | 10/2000 | Bourgoyne, Jr. et al. |
| 6,412,574 | B1 | 7/2002 | Wardley et al. |
| 6,543,552 | B1 | 4/2003 | Metcalfe et al. |
| 6,742,606 | B2 | 6/2004 | Metcalfe et al. |
| 6,854,533 | B2 | 2/2005 | Galloway et al. |
| 6,857,487 | B2 | 2/2005 | Galloway et al. |
| 6,899,186 | B2 | 5/2005 | Galloway et al. |
| 7,013,997 | B2 | 3/2006 | Vail, III |
| 7,036,610 | B1 | 5/2006 | Vail, III |
| 7,040,420 | B2 | 5/2006 | Vail, III |
| 7,048,050 | B2 | 5/2006 | Vail, III et al. |

(Continued)

FOREIGN PATENT DOCUMENTS

CA 2538196 8/2006

(Continued)

OTHER PUBLICATIONS

Weatherford "R Running Tool with Hydraulically Released Mechanical Lock", 2006, pp. 1-2.

(Continued)

*Primary Examiner* — William P Neuder
*Assistant Examiner* — Catherine Loikith
(74) *Attorney, Agent, or Firm* — Bracewell & Giuliani LLP

(57) ABSTRACT

A liner drilling system employs a bottom hole assembly that may be retrieved before reaching the total liner depth. The system includes an outer string made up of a liner and a profile nipple. An inner string including a running tool, drill pipe, and a drill lock tool are lowered into the outer string and rotationally and axially locked to the outer string. Drilling may be performed by rotating the inner string, which also rotates the outer string. The operator may retrieve the inner string by pulling the inner string and the liner upward until the upper end of the liner is located at the drilling rig floor. While supporting the liner at the drilling rig floor, the operator retrieves the inner string, then re-runs it back into the outer string.

19 Claims, 12 Drawing Sheets

U.S. PATENT DOCUMENTS

| | | | | |
|---|---|---|---|---|
| 7,083,005 | B2 | 8/2006 | Galloway et al. | |
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,084 | B2 | 9/2006 | Vail, III | |
| 7,117,957 | B2 | 10/2006 | Metcalfe et al. | |
| 7,147,068 | B2 | 12/2006 | Vail, III | |
| 7,165,634 | B2 | 1/2007 | Vail, III | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 2001/0017210 | A1 | 8/2001 | Howlett | |
| 2004/0221997 | A1* | 11/2004 | Giroux et al. | 166/380 |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0175665 | A1 | 8/2007 | Tessari et al. | |
| 2007/0267221 | A1 | 11/2007 | Giroux et al. | |
| 2009/0090508 | A1 | 4/2009 | Brouse | |
| 2009/0101345 | A1 | 4/2009 | Moffitt et al. | |

FOREIGN PATENT DOCUMENTS

| | | | |
|---|---|---|---|
| WO | WO2007/011906 | A1 | 1/2007 |

OTHER PUBLICATIONS

Drilling Contractor "Liner Drilling Technology Being Prepared for Offshore", Jan./Feb. 2004, pp. 14-15.

Dril-Quip LS-15 Liner Hanger System, Sales Manual, pp. 5-7.

TIW "Liner Equipment" HLX Liner-Top Packer, pp. 5, 9-11, 18-19.

Dril-Quip "LS-15 Liner Hanger System", pp. 1-2, 4 and 6.

U.S. Appl. No. 12/275,396, filed Nov. 21, 2008.

U.S. Appl. No. 12/238,191, filed Sep. 25, 2008.

World Oil/Oct. 1999—Drilling Technology "Casing-While-Drilling: The Next Step Change in Well Construction", pp. 34-36 and 38-40.

Rotary Steerable Drilling with Liner—during 2007 or later based on the text—Randi Elisabeth Hugdahl, Leader, TNE RD RCT DWPT—pp. 3-5.

Drilling Liner Technology for Depleted Reservoir, C. Vogt, SPE and F. Makohl, SPE, Baker Hughes INTEQ; P. Suwamo, SPE and B. Quitzau, SPE, Mobile Oil Indonesia—SPE 36827—pp. 127-132.

Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq., Glenn Stewart, Baker Hughes Inteq—SPE International, IADC/SPE 59126, Feb. 23-25, 2000, pp. 1-9.

U.S. Appl. No. 11/461,248, filed Jul. 31, 2006.

U.S. Appl. No. 12/347,443, filed Dec. 31, 2008.

Drilling Liner Technology for Depleted Reservoir, C. Vogt, SPE and F. Makohl, SPE, Baker Hughes INTEQ; P. Suwarno, SPE and B. Quitzau, SPE. Mobil Oil Indonesia—SPE 36827—pp. 127-132, 1996.

* cited by examiner

LINER DRILLING SYSTEM AND METHOD OF LINER DRILLING WITH RETRIEVABLE BOTTOM HOLE ASSEMBLY

CROSS-REFERENCE TO RELATED APPLICATION

This application is a continuation-in-part of Ser. No. 12/238,191, filed Sep. 25, 2008, which claimed priority to provisional application Ser. No. 60/977,263, filed Oct. 3, 2007.

FIELD OF THE INVENTION

This invention relates in general to oil and gas well drilling while simultaneously installing a liner in the well bore.

BACKGROUND OF THE INVENTION

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than another string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner hanger, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. A drill bit is located at the lower end of the liner. This method is similar to a related technology known as casing drilling. One option is to not retrieve the drill bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits. Retrievable bottom hole assemblies are known for casing drilling, but in casing drilling, the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. With liner drilling, the drill pipe that suspends the liner is much smaller in diameter than the liner and has no room for a bottom hole assembly to be retrieved through it. Being unable to retrieve the bit for replacement thus limits the length that can be drilled and thus the length of the liner. If unable to retrieve and rerun the bottom hole assembly, the operator would not be able to liner drill with expensive directional steering tools, logging instruments and the like, without planning for removing the entire liner string to retrieve the tools.

If the operator wishes to retrieve the bottom hole assembly before cementing the liner, there are no established methods and equipment for doing so. Also, if the operator wishes to rerun the bottom hole assembly and continue drilling with the liner, there are no established methods and equipment for doing so. Some liner drilling proposals involve connecting a bottom hole assembly to a string of drill pipe and running the drill pipe to the bottom of the liner. Retrieving the drill string at the conclusion of the drilling would retrieve the bottom hole assembly.

One difficulty to overcome in order to retrieve and rerun a bottom hole assembly during liner drilling concerns how to keep the liner from buckling if it is disconnected from the drill pipe and left in the well. If the liner is set on the bottom of the well, at least part of the drilling bottom hole assembly could be retrieved to replace a bit or directional tools. But, there is a risk that the liner might buckle due to inadequate strength to support its weight in compression.

SUMMARY OF THE INVENTION

In this invention, the operator assembles concentric inner and outer strings of tubulars, the outer string including a string of riser, and the inner string including a bottom hole assembly that axially and rotationally latches to the outer string. The operator lowers the outer string and inner string into a well from a drilling rig by connecting additional tubulars to the inner string. When on bottom, the operator rotates the inner string, which translates rotation to the drill bit to deepen the well.

If a need arises to change out the bottom hole assembly before reaching the total depth for the string of liner, the operator raises the inner and outer strings together until the upper end of the outer string is at the drilling rig. The operator supports the outer string with slips, then releases the latch between the inner and outer strings and removes the inner string. The operator reassembles the inner string, runs it back into the outer string and latches the inner string to the outer string. The operator then runs the whole assembly back into the well to continue drilling.

In the preferred embodiment, torque imposed on the inner string at the drilling rig transfers from the inner string to the outer string at the upper end of the string of liner. The torque transfers from the outer string back to the inner string at lower point where the inner string latches to the outer string, near the bottom of the liner.

DETAILED DESCRIPTION OF THE INVENTION

Figure 1:
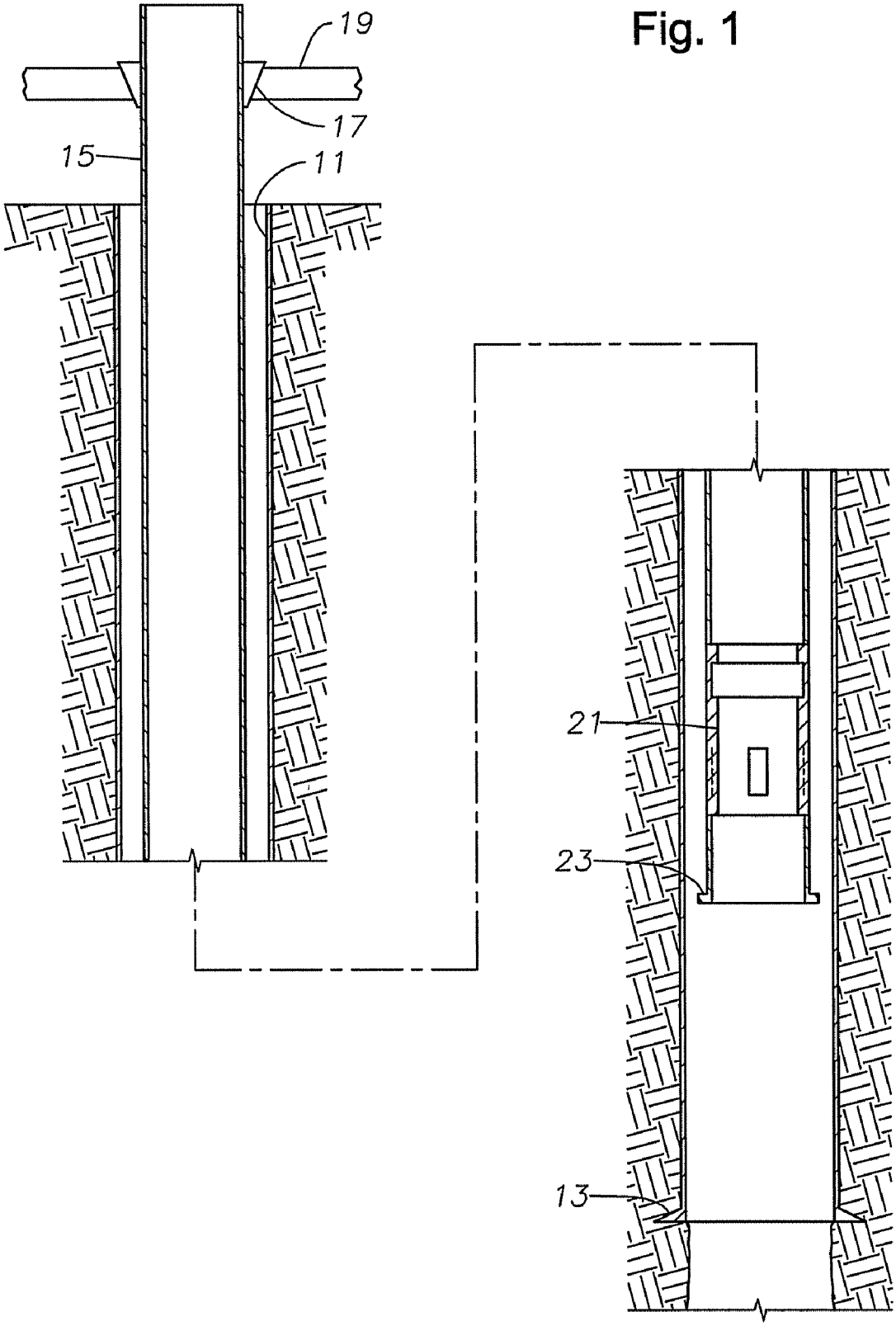
FIG. 1 is a schematic view illustrating an outer string suspended at a rig floor in accordance with this invention.

Referring to FIG. 1, normally one or more strings of casing 11 will be installed in the well before beginning the liner drilling operation of this invention. Only one string of casing 11 is shown, but more could be previously installed. Casing 11 may be installed in any known manner and is cemented in place. Typically, a casing shoe 13 will be located at the lower end of casing 11.

A first step of this system involves assembling an outer or liner string 15 and suspending it in casing 11. Liner string 15 is made up of tubulars that may be the same type of pipe as used for casing. Liner string 15 will eventually be cemented in the well, however, its upper end will be located a short distance above casing shoe 13, rather than extending all the way to the surface. Normally, one refers to the term "casing" as being a string of pipe that extends all the way to the surface when cemented in place. However, the terms "liner" and "casing" may be used interchangeably.

Liner string 15 is supported by a spider or slips 17 located at a drilling rig floor 19. The upper end of casing 11 will be located a short distance below. Liner string 15 has a profile nipple 21 assembled within it. Profile nipple 21 is a tubular member that has a machined profile within it for purposes that will be subsequently explained. In the example shown, profile nipple 21 is located a relatively short distance above a liner shoe 23, which is the lower end of liner string 15. However, it could be mounted in liner string 15 at other points. Preferably, liner string 15 will be made up to its full length before commencing liner drilling, which may be a few hundred feet to several thousand feet. While liner string 15 is suspended at rig floor 19, liner shoe 23 will be spaced above casing shoe 13. Liner shoe 23 may include cutting elements for cutting a sidewall of the borehole.

Figure 2A:
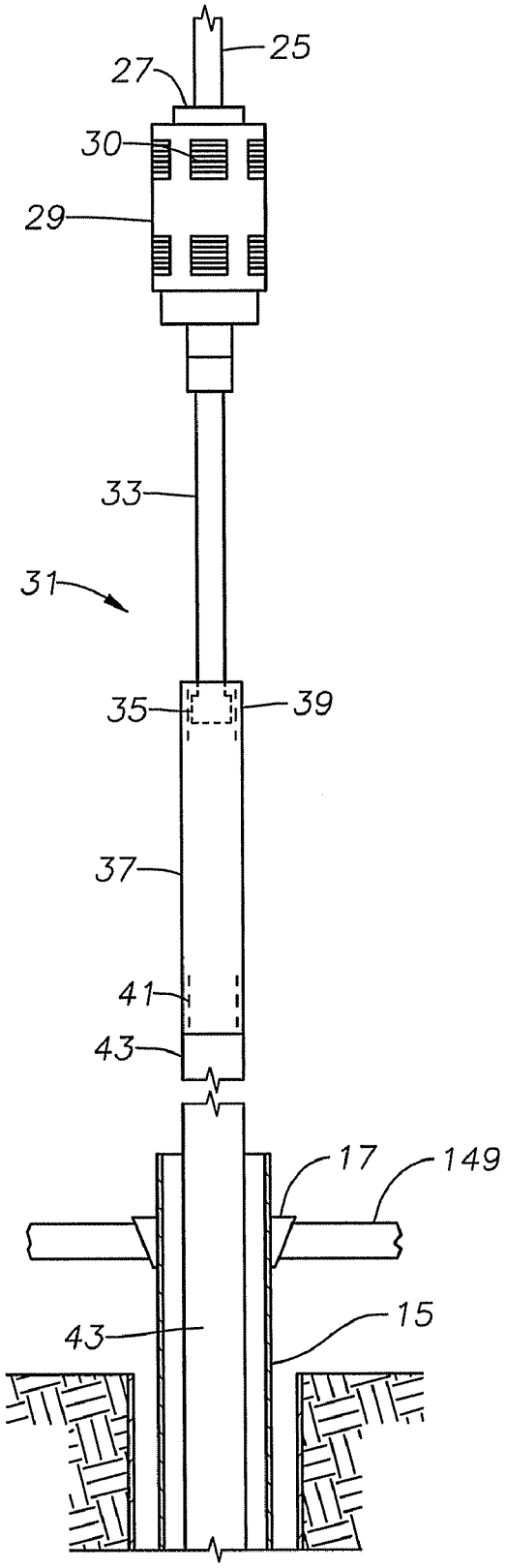
FIGS. 2A and 2B illustrate an inner string being lowered into the outer string of FIG. 1.
Figure 2B:
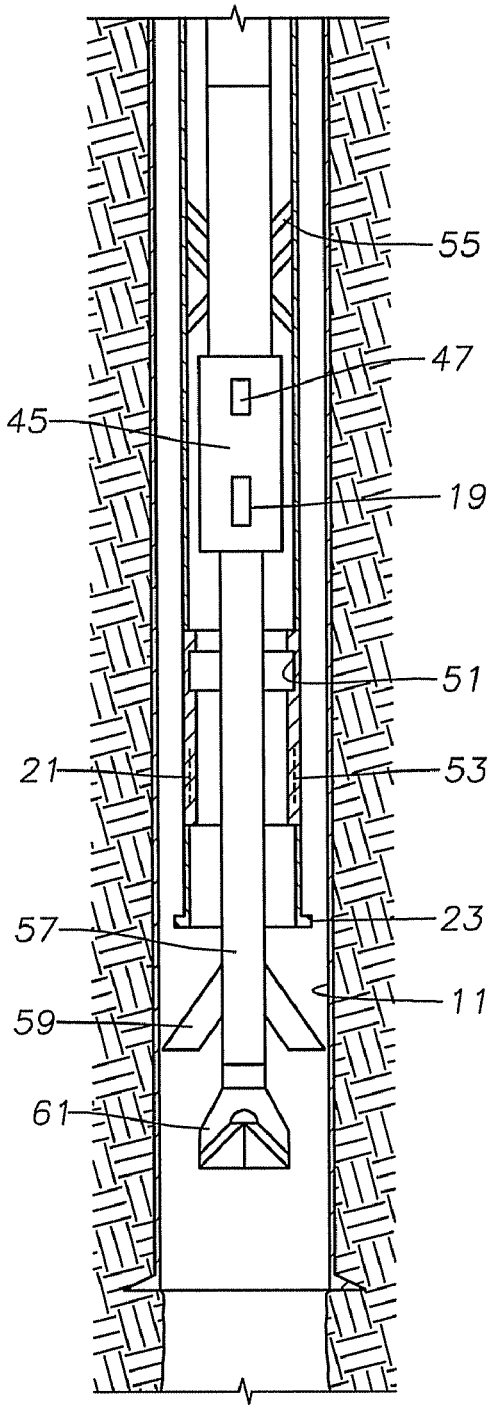
Figure 8:
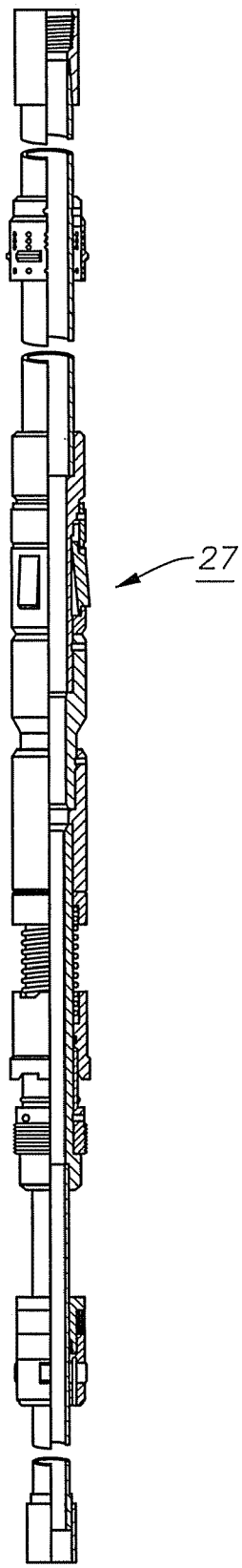
FIG. 8 is a partially sectioned elevational view of a liner hanger running tool that may be employed to run the outer string of FIG. 1.
Figure 9:
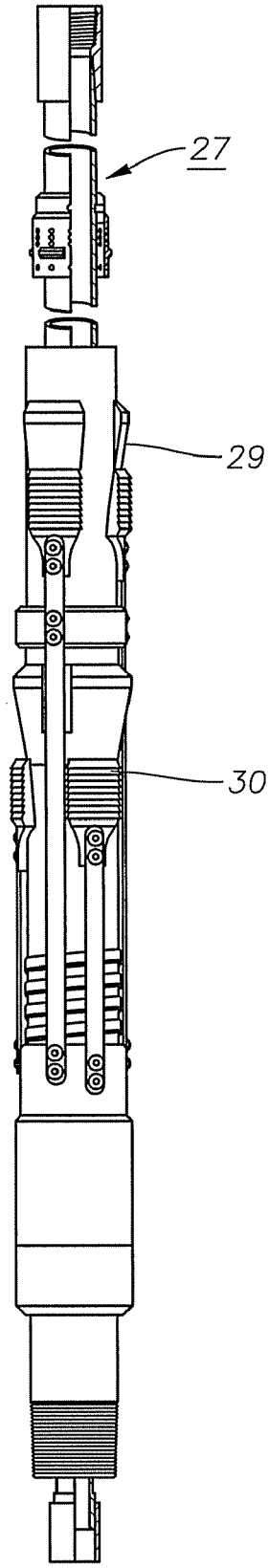
FIG. 9 is a partially sectioned elevational view of a liner hanger that may be attached to the outer string of FIG. 1.

The operator then assembles an inner string to lower into liner string 15. Referring to FIGS. 2A and 2B, the inner string includes an upper drill pipe string 25 that is secured to the upper end of a liner hanger running tool 27. Upper drill pipe string 25 extends up to a rotary drive source of the drilling rig, often a top drive. Running tool 27 is a conventional tool employed to run and install a liner hanger 29. Liner hanger 29 is also a conventional piece of equipment. Many different types of liner hanger running tools 27 and liner hangers 29 exist. FIGS. 8 and 9 show an example of a suitable liner hanger running tool 27 and liner hanger 29 that are sold by Texas Iron Works, Houston, Tex. Other sources manufacture and sell liner hangers and liner hanger running tools that will also serve the purpose of this invention. Liner hanger 29 has a lower end that secures, such as by threads, to the upper end of liner string 15. Liner hanger 29 has slips 30, that when actuated by running tool 27, will grip the inner diameter of casing 11 to support the weight of liner string 15.

In this embodiment, an extension joint or telescoping sub 31 is secured to the lower end of running tool 27. Telescoping sub 31 has an inner pipe 33 with an engagement member 35 on its lower end. Inner pipe 33 is carried within an outer pipe 37 of approximately the same length. Outer pipe 37 preferably has an upper engagement end or clutch 39 that contains splines, grooves or threads for engagement by inner pipe engagement end 35. When engaged, which occurs when telescoping sub 31 is fully extended, rotation of inner pipe 33 causes outer pipe 37 to rotate. Outer pipe 37 optionally may have a lower engagement end or clutch 41 that has similar grooves, splines or threads for receiving inner pipe engagement end 35. When engagement end 35 engages lower clutch 41, which occurs if telescoping sub 31 is fully contracted, torque applied to inner pipe 33 will rotate outer pipe 37. Inner pipe 33 is shown extending upward from outer pipe 37, but they could be reversed with outer pipe 37 on the upper end of telescoping sub 31. When inner pipe engagement end 35 is located between upper and lower clutches 39, 41, inner pipe 33 is free to rotate without imposing any torque on outer pipe 37.

Figure 3A:
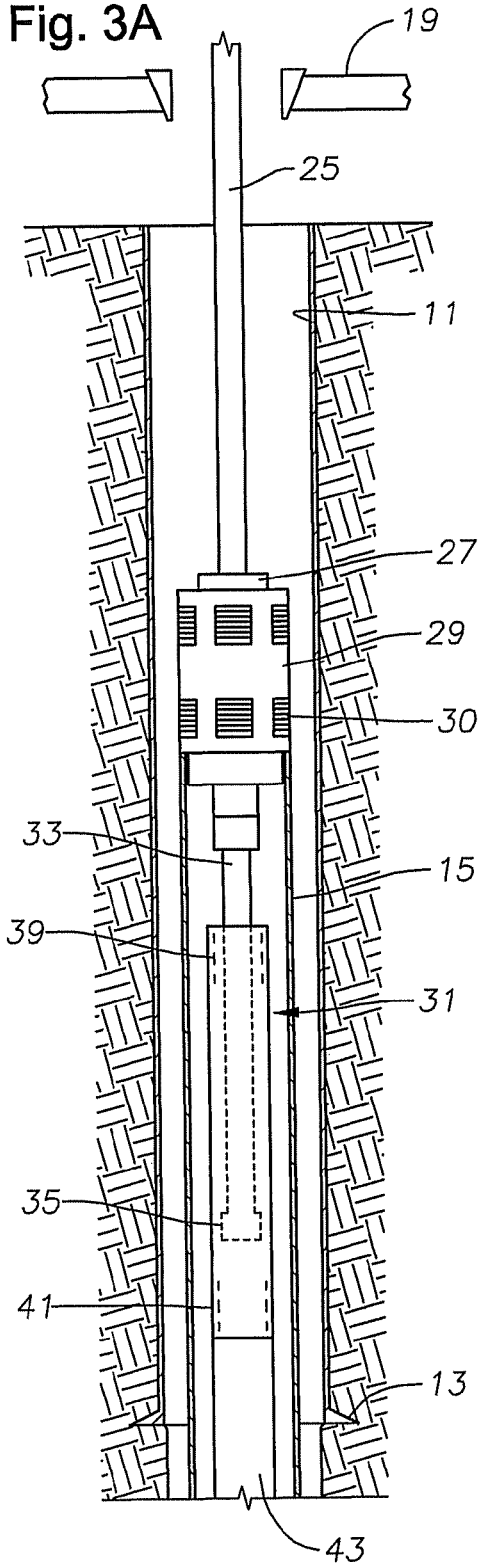
FIGS. 3A and 3B illustrate the inner string latched axially and rotationally to the outer string, and the drill bit deepening the well.
Figure 10:
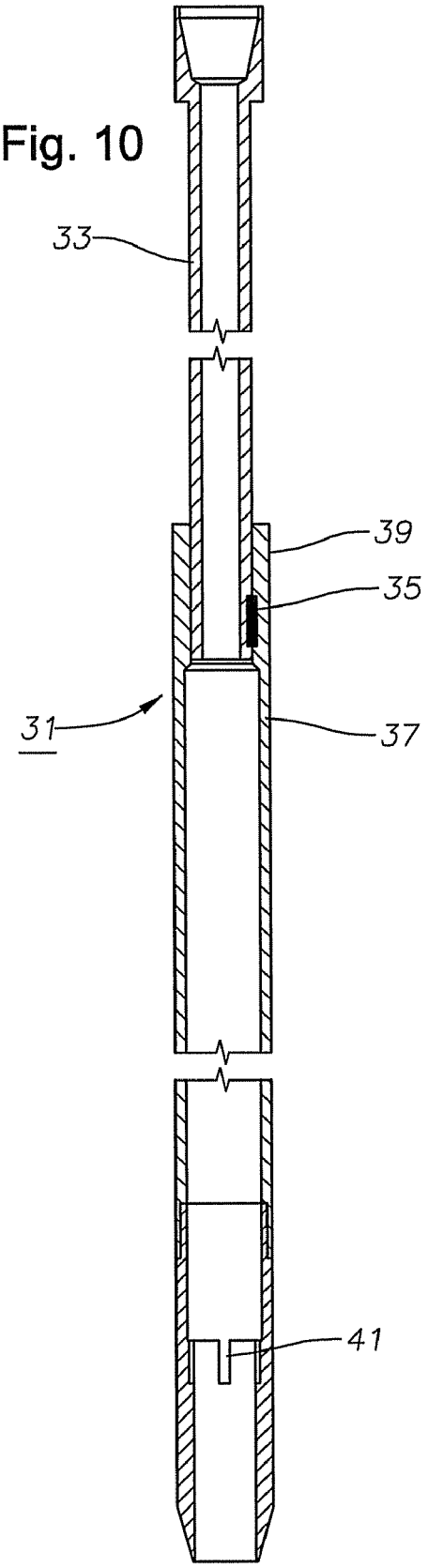
FIG. 10 is an enlarged sectional view of a telescoping sub connected into the inner string of FIG. 2A and shown in an extended position.
Figure 14:
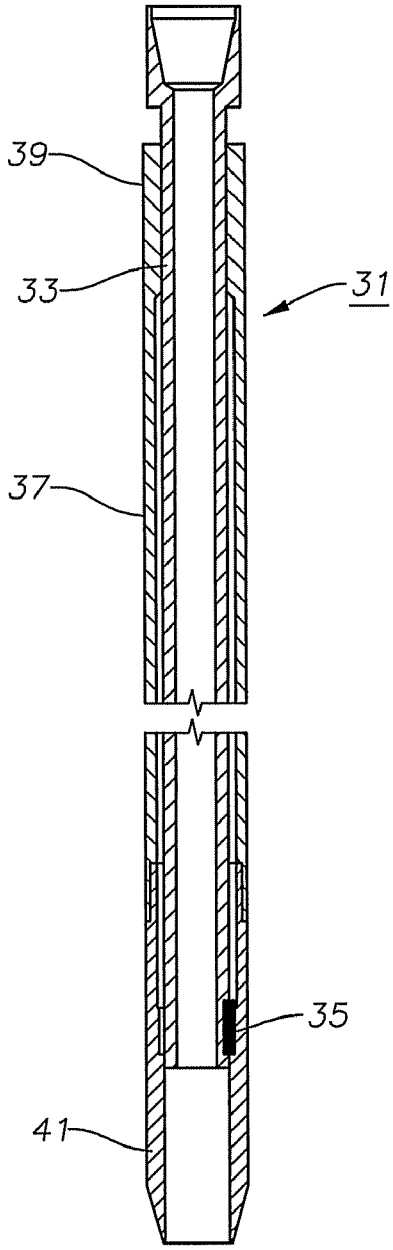
FIG. 14 is a sectional view of the telescoping sub of FIG. 10, shown in a contracted position.
Figure 16:
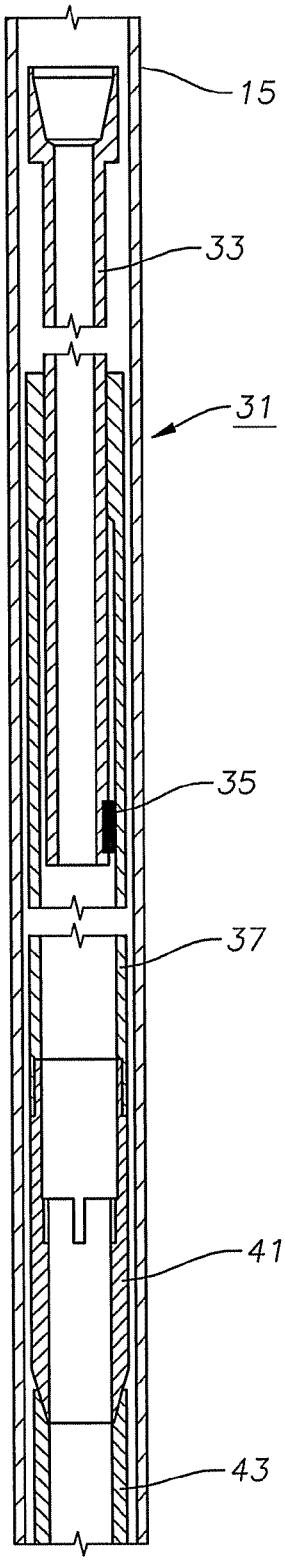
FIG. 16 is a sectional view of the telescoping sub of FIG. 10, shown in a neutral position.

FIG. 2A illustrates telescoping sub 31 in an extended position. Optionally, shear fasteners (not shown) may be connected between inner pipe engagement end 35 and outer pipe upper clutch 39 to retain telescoping sub 31 in the extended position during run in. FIG. 3A shows telescoping sub 31 in a neutral position with inner pipe engagement end 35 located between upper and lower clutches 39, 41 of outer pipe 37. FIGS. 10, 14 and 16 are somewhat more detailed views of telescoping sub 31, with FIG. 10 showing telescoping sub 31 extended, FIG. 14 showing telescoping sub 31 contracted, and FIG. 16 showing telescoping sub 31 in a neutral position. Although not shown, telescoping sub 31 has seals that seal fluid pressure within its axial passage extending through inner pipe 33 and outer pipe 37. Preferably, the seals will seal fluid pressure regardless of the position telescoping sub 31 is in.

Referring again to FIGS. 2A and 2B, the inner string includes a lower drill pipe string 43, which extends from the lower end of telescoping sub outer pipe 37. Lower drill pipe string 43 made be made up of the same type of drill pipe as upper drill pipe string 25. Normally, upper and lower drill pipe strings 25, 43 will comprise conventional drill pipe members, each having threaded ends that are secured together. Other types of conduit may be suitable.

A drill lock assembly or tool 45 attaches to the lower end of lower drill pipe string 43 as shown in FIG. 2B. Drill lock tool 45 is shown spaced above profile nipple 21 in FIG. 2B and in engagement with profile nipple 21 in FIGS. 3B and 4. As lower drill pipe string 43 is run into liner string 15, drill lock tool 45 will land on a no-go shoulder in profile nipple 21, stopping all downward movement of the inner string. Drill lock tool 45 has axial locks 47 that move between retracted and extended positions. Drill lock tool 45 also has torque keys 49 that are normally biased outward. When located within profile nipple 21, the operator causes drill lock tool 45 to extend axial locks 47 into an annular recess 51 in profile nipple 21. Torque keys 49 will engage axial grooves 53 for transmitting torque. When engaged, axial locks 47 lock drill lock tool 45 to profile nipple 21 so that upward or downward movement of the inner string causes similar upward and downward movement of the outer string. Axial locks 47 also enable the inner string to support the weight of at least a portion of liner string 15. Optionally, an assembly of cup seals 55 may be mounted to the upper end of drill lock tool 45. If employed cup seals 55 seal against the inner diameter of liner string 15.

Referring still to FIG. 2B, the inner string includes auxiliary equipment 57, which secures to drill lock tool 45 and extends below liner shoe 23 a short distance. Auxiliary equipment 57 may be simply a string of pipe, or it may comprise well logging instruments, a mud motor, a directional steering tool, or any combination thereof. An underreamer 59 is attached to the lower end of auxiliary equipment 57 in this example. Underreamer 59 has collapsible arms that engage the borehole to enlarge it to a diameter greater than the outer diameter of liner string 15. A pilot bit 61 is located at the lower end of the inner string.

In the operation of the components shown in FIGS. 1-4, the operator first makes up liner string 15 with profile nipple 21 and suspends liner string 15 with slips 17. The operator then makes up within liner string 15 a bottom hole assembly comprising drill bit 61, underreamer 59, auxiliary equipment 57 and drill lock tool 45. The operator runs the bottom hole assembly in on an inner string including lower drill pipe string 43 and telescoping sub 31. Preferably, telescoping sub 31 is at the upper end of lower drill pipe string 43, but it could be positioned at other points. Underreamer 59 and drill bit 61 pass through the inner diameter of profile nipple 21. Telescoping sub 31 will still be in an extended position when drill lock tool 45 lands in profile sub 21. In one example, slacking off weight of lower drill pipe string 43 applies a downward force on drill lock tool 45 to cause axial locks 47 of drill lock tool 45 to lock into recess 51 in profile nipple 21. If an obstacle is encountered before drill lock tool 45 reaches profile nipple 21, the operator can rotate drill bit 61 and drill lock tool 45 to attempt to overcome the hang-up, because telescoping sub 31 transmits rotation while in the extended position. Also, if some rotation is required in order to get drill lock tool 45 to properly engage profile nipple 21 after it has landed, the operator can rotate drill lock tool 45 by rotating lower drill string 45 and telescoping sub 31.

After the operator is confident that drill lock tool 45 has properly locked to profile nipple 21, he connects liner hanger running tool 27, which may be previously installed within liner hanger 29, to the upper end of telescoping sub 31. The operator applies weight above telescoping sub 31 to cause its shear element to shear, allowing it to contract from the extended position. As telescoping sub 31 contracts, liner hanger 29 will engage the upper end of liner string 15. The operator secures liner hanger 29 to the upper end of liner string 15, such as by rotating running tool 27. Once liner hanger 29 is secured, liner hanger running tool 27 is connected rotationally and axially to liner string 15 through liner hanger 29. After being latched rotationally and axially at liner hanger 29 and drill lock tool 45, the inner and outer strings make up a concentric string assembly.

The inner string is thus connected rotationally and axially to liner string 15 at the upper end of liner string 15 and also near the lower end of liner string 15, at profile nipple 21. The operator will know the approximate length of liner string 15 from its upper end to profile nipple 21, but it would be difficult to precisely assemble the inner string so that the distance from drill lock tool 45 to liner hanger 29 exactly matched that distance. Telescoping sub 31 may have a length that ranges from about 10 feet to 20 feet or more from the contracted to the extended position, thus avoids the need for the operator to precisely match the distance from profile nipple 21 to the upper end of liner string 15.

Once liner hanger 29 is engaged with liner string 15, running tool 27 will be able to transmit torque to liner string 15. Because telescoping sub 31 is in a neutral position, torque imposed on upper drill string 25 will not pass through telescoping sub 31 to lower drill pipe string 43.

After making up liner hanger 29 with liner string 15, the operator lifts liner string 15 slightly with upper drill pipe string 25, releases slips 17, and lowers the entire concentric string assembly into the well. The operator will add more joints of drill pipe to upper drill pipe string 25 until pilot bit 61 reaches the bottom of the wellbore, which typically is at casing shoe 13. The operator begins pumping drilling fluid down upper drill pipe string 25 and begins rotating upper drill pipe string 25. Torque imposed on upper drill pipe string 25 by the top drive or rotary table of the drilling rig passes through liner hanger 29 to liner string 15. The torque then passes from liner string 15 through profile nipple 21 to drill lock tool 45. Drill lock tool 45 transfers that torque to auxiliary equipment 57, underreamer 59 and drill bit 61. In this embodiment, drill lock tool 45 would also transmit rotational force to lower drill pipe string 43, causing it to rotate. The outer pipe 37 of telescoping sub 31 would also be rotating even though in the neutral position of FIG. 3A. However, no torque is transmitted between telescoping sub inner pipe 33 and outer pipe 37.

Figure 3B:
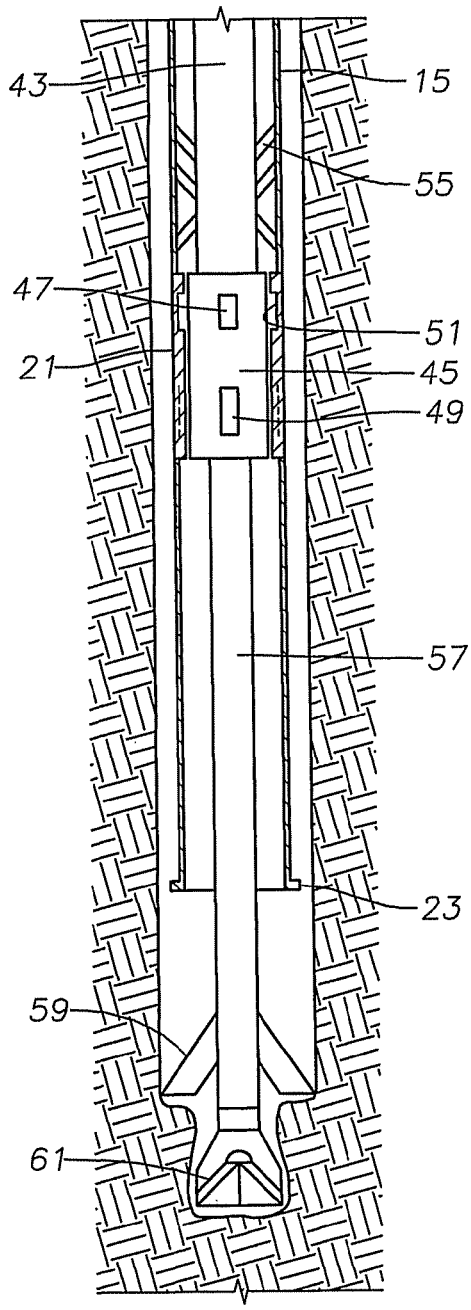

The drilling fluid being pumped down upper drill pipe string 25 flows through telescoping sub 31 and lower drill pipe string 43, drill lock tool 45, auxiliary equipment 57 and out the lower end of drill bit 61. The drilling fluid in the preferred embodiment flows back up the outer annulus between liner string 15 and the borehole wall and casing 11. Cup seals 55, if employed, prevent the flow of drilling fluid up liner string 15. Cup seals 55 could be eliminated and a seal located between running tool 27 and liner hanger 29 or the upper end of liner string 15. FIGS. 3A and 3B illustrate the position of the downhole equipment after the casing shoe 13 has been drilled out and the well deepened a considerable distance.

The operator may wish to retrieve the bottom hole assembly before reaching the total desired depth of liner string 15 because of repair or replacement of drill bit 61 or auxiliary equipment 57. If so, referring to FIG. 4, the operator simply begins pulling up the entire downhole assembly by lifting upper drill pipe string 25 and removing various sections of upper drill pipe string 25 as they are brought to the surface. The upward pull on upper drill pipe string 25 will not move telescoping sub 31 to the extended position yet because running tool 27 and liner hanger 29 are still engaged with the top of liner string 15.

Eventually, substantially all of the upper drill pipe string 25 will be removed and liner hanger 29 will be located above slips 17. The operator actuates slips 17 to support liner string 15. Liner shoe 23 will be spaced above casing shoe 13 again. Liner hanger 29 will be extending upward from liner string 15. The operator disengages liner hanger 29 from liner string 15 by a suitable method, such as left-hand rotation. The operator then sets liner running tool 25 and liner hanger 29 aside and retrieves the remaining components of the inner string by first unlatching drill lock tool 45 from profile nipple 21. In the preferred embodiment, this is handled simply by pulling upward on telescoping sub 31 with a sufficient force, which causes telescoping sub 31 to fully extend and transmit the upward force to lower drill pipe string 43. Preferably, drill lock tool 45 releases from profile nipple 21 in response to a straight upward pull. If some rotation of drill lock tool 45 relative to liner string 15 is needed to release it from profile nipple 21, rotation of telescoping sub 31 will transmit torque to lower drill pipe string 43 and drill lock tool 45 because telescoping sub 31 transmits torque while in the extended position.

The operator thus will pull to the surface and set aside telescoping sub 31, lower drill pipe string 43, drill lock tool 45, underreamer 59 and drill bit 61. Once retrieved, liner string 15 will be free of internal components and will appear as illustrated in FIG. 1. The operator reassembles the inner string by resetting drill lock tool 45 and repairing or replacing any of the auxiliary equipment 57, underreamer 59 or drill bit 61. The operator then reruns the entire assembly in the same manner as previously described when first beginning the liner drilling operation. The operator will land drill lock tool 45 in profile nipple 21 and cause its axial locks 47 to engage annular recess 51. The operator will then attach running tool 27 to telescoping sub 31, lower liner hanger 29 into engagement with the upper end of liner string 15 and secure it, normally by right hand rotation. This step would cause the shear fastener of telescoping sub 31 to shear, allowing telescoping sub 31 to contract to a neutral position. The operator then lifts the entire assembly, releases slips 17 and lowers the entire assembly of the inner string and liner string 15 to the bottom of the well to again commence drilling.

Figure 4A:
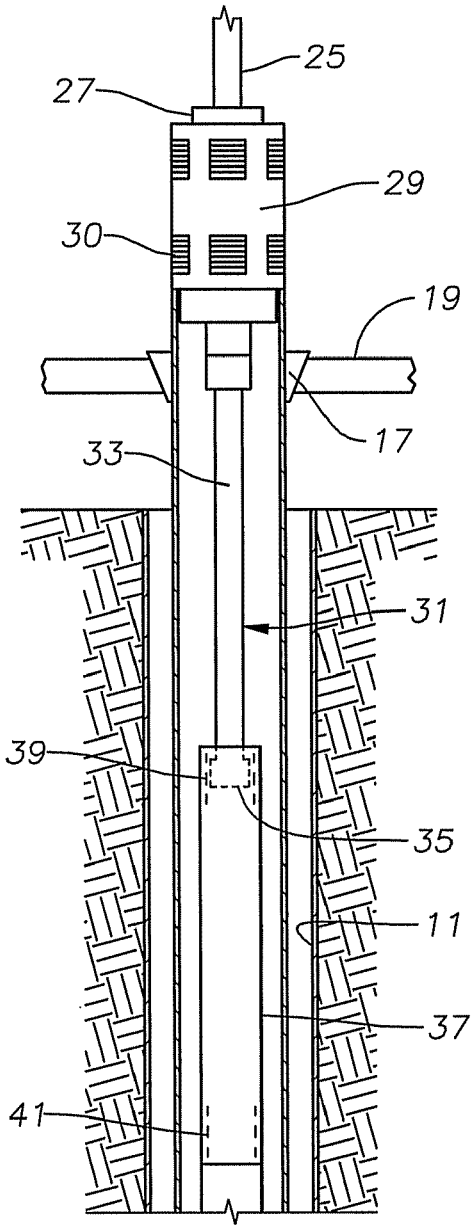
FIGS. 4A and 4B illustrate the operator pulling up the outer string and suspending it at the drilling rig floor in order to retrieve the bottom hole assembly for rerunning.
Figure 4B:
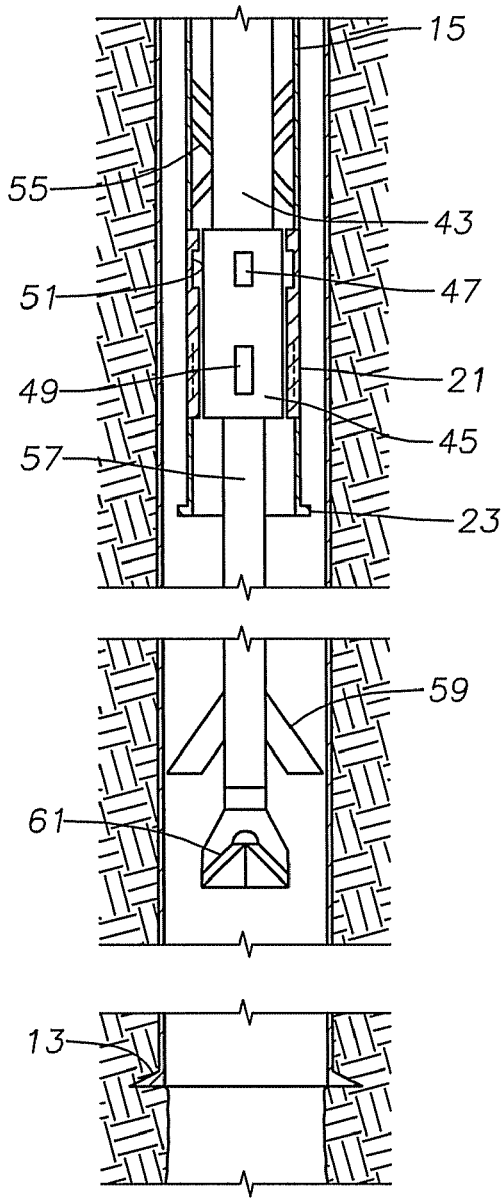
Figure 5:
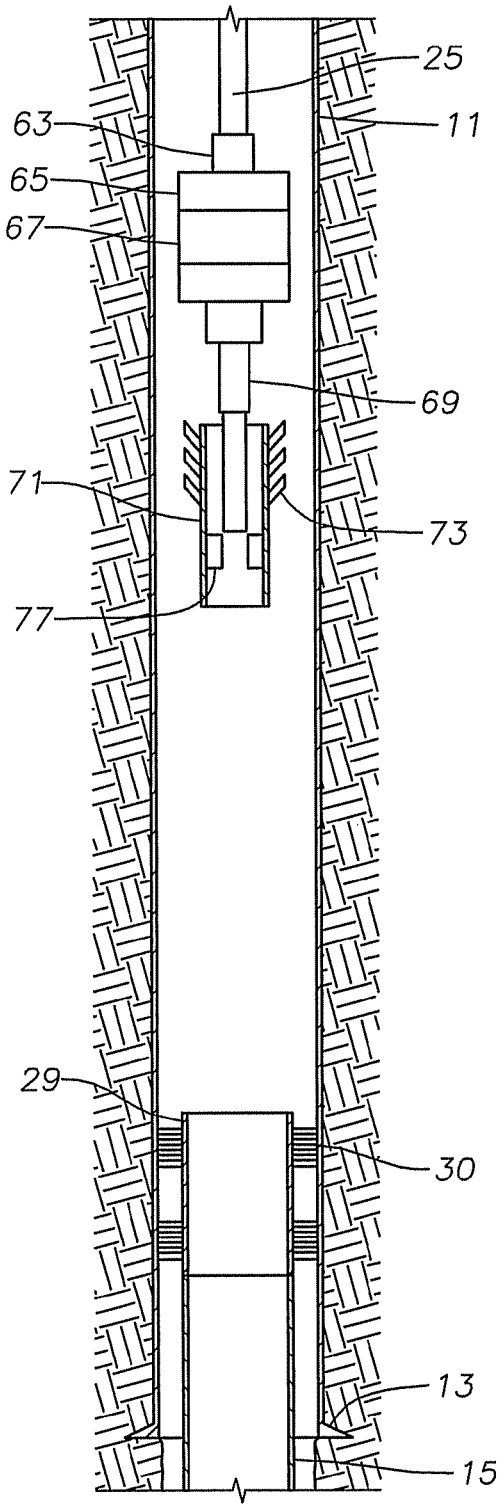
FIG. 5 illustrates the outer string supported by a liner hanger to a previously installed string of casing after the outer string has reached total depth, and a cementing assembly being lowered for cementing the outer string.

After drilling liner string 15 reaches its total depth, the operator will set liner hanger 29 so that its slips 30 engage the inner diameter of casing 11, as schematically illustrated in FIG. 5. Liner hanger 29 will normally be a short distance above casing shoe 13. However, the total liner depth may occur earlier because of various drilling problems. If so, liner hanger 29 may be quite a distance above casing shoe 13. Setting liner hanger 29 may be done in a variety of manners. Typically, the operator will drop a sealing element, such as a ball or dart, which then lands within running tool 27 (FIG. 4). The operator pumps fluid under pressure through upper drill pipe string 25 to cause slips 30 to grip the inner diameter of casing 11. The operator releases running tool 27 in a conventional manner from liner hanger 29 and begins lifting the inner string. Telescoping sub 31 will move to the extended position illustrated in FIG. 2A. Continued upward movement causes drill lock tool 45 to unlatch from profile nipple 21, retrieving the entire inner string. If some rotational movement is necessary while retrieving, the operator can transmit rotation to drill lock tool 45 because while in the extended position, inner pipe 33 is rotationally locked to outer pipe 37 of telescoping sub 31 via engagement end 35 and upper clutch 39. When engaged, the operator can rotate upper drill pipe string 25 and torque will be transmitted between inner pipe 31 and outer pipe 37 all the way down to drill bit 61. Because liner hanger running tool 27 is no longer in engagement with liner hanger 29, no rotational or axial force is imparted to liner hanger 29 by running tool 27 after liner hanger 29 has been set.

Figure 18:
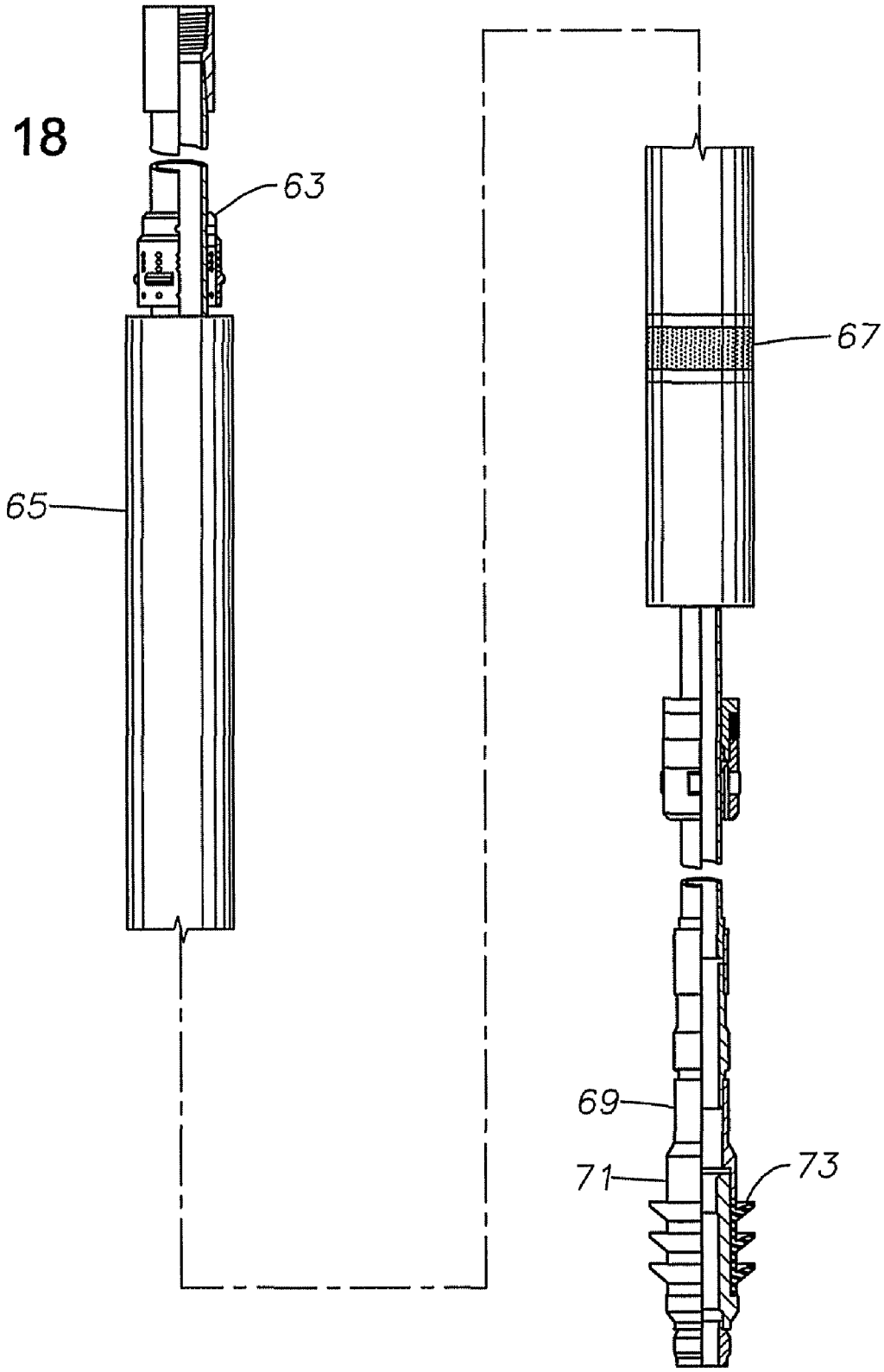
FIG. 18 is an elevational view, partially sectioned, of the cementing tool and packer of FIG. 5.

The operator retrieves the inner string and then assembles a cementing string as illustrated in FIGS. 5 and 18. The cementing string includes a cement running tool 63 that may be quite similar to running tool 25 (FIG. 2A). Optionally, the operator may wish to set a liner top packer 65. If so, cement running tool 63 extends through and engages packer 65 as illustrated in FIGS. 5 and 18. Packer 65 may be a conventional type packer and may be set in a variety of manners. In one embodiment, it may be set by a downward compressive force. Packer 65 has an elastomeric sealing element 67 that is intended to seal against the inner diameter of casing 11.

A cement retainer launch tube 69, which may simply be a tubular member with a releasable internal seat, extends below cement running tool 63. A cement retainer 71 is located on the lower end of launch tube 69. In this example, cement retainer 71 is of a type that is adapted to be pumped down liner string 15, thus has seals 73 on its exterior for engaging liner string 15. In this example, cement retainer 71 has an axial passage that is open so that the operator can pump cement through it while it is still attached to cement retainer launch tube 69. Preferably, cement retainer 71 has a latch 77 (FIG. 5) that is adapted to engage an annular groove in profile nipple 21, which could be the same as annular groove 51 or a different one.

Figure 6:
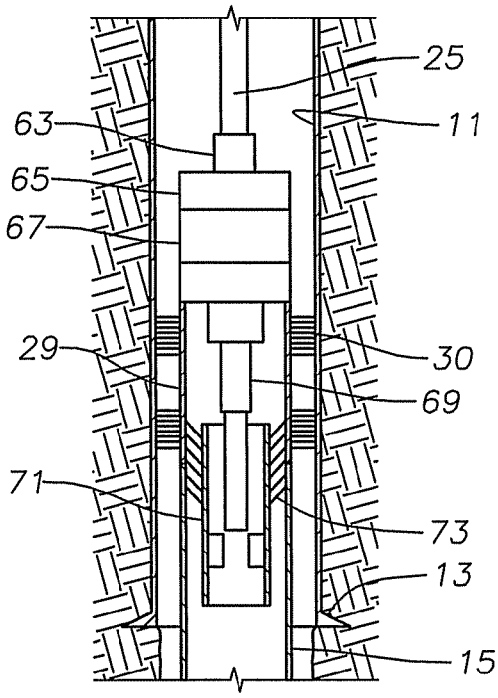
FIG. 6 shows the cementing assembly of FIG. 5 in engagement with the liner hanger.

In the cementing operation, the operator will lower the assembly shown in FIGS. 5 and 18 on upper drill pipe string 25 (FIG. 5), or some other suitable conduit, until cement running tool 63 lands on the previously set liner hanger 29, as shown in FIG. 6. Liner hanger 29 has an overshot structure on its upper end to receive cement retaining tool 63. Cement retaining tool 63 latches to cement retainer 29 by a suitable mechanism, such as right hand rotation. The operator then pumps cement down upper drill pipe string 25. It flows through cement retainer 71 while cement retainer 71 is still supported on launch tube 69.

Figure 7:
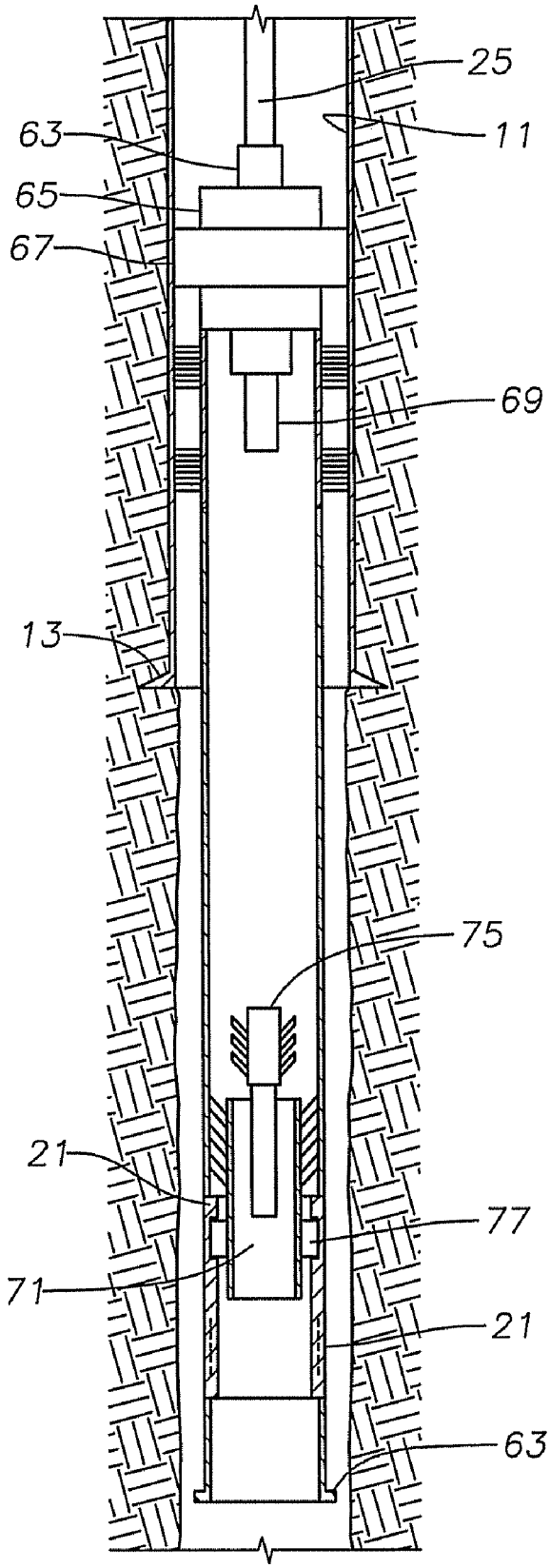
FIG. 7 illustrates a cement retainer being pumped down from the cementing assembly of FIG. 6 into engagement with a profile nipple in the outer string following the pumping of cement.

When the measured quantity of cement has been dispensed, the operator drops a sealing element 75, which may be a ball or dart, as shown in FIG. 7. Sealing element 75 is pumped down upper drill pipe string 25 into engagement with the seat holding cement retainer 71. The operator applies sufficient fluid pressure to cause a shear mechanism between the seat and launch tube 69 to shear, which releases cement retainer 71. Sealing element 75 has seals that engage a portion of the passage in cement retainer 71, thus enabling fluid pressure to pump the two components down liner string 15. When cement retainer 71 lands in profile nipple 21, latch 77 springs out into engagement with a recess to latch cement retainer 71 in place as illustrated in FIG. 7. Sealing element 75 not only seals to the inner passage in cement retainer 71, it also latches. When being pumped down, cement retainer 71 and sealing element 75 push cement downward, out the lower end of liner shoe 23 and up the annulus surrounding liner string 15. Once latched in profile nipple 21, sealing element 75 and cement retainer 71 prevent any backflow of cement from the annulus back into liner string 15 above profile nipple 21.

The operator then releases cement running tool 63 from packer 65 in a conventional manner and sets packer 65. In one type of arrangement, this is handled by applying downward weight from upper drill pipe string 25 to cement running tool 63 after it has been released from packer 65. The weight causes packer element 67 to expand out, and gripping mechanisms of packer 65 will grip and engage casing 11. The operator retrieves upper drill pipe string 25 and cement running tool 63.

Although described to be a valve-less type that is pumped down after dispensing the cement, cement retainer 71 may be a variety of types. For example, a cement retainer pumped down before dispensing cement could be employed. If so, it would normally have a valve within it, such as a flapper valve, to block return flow of cement. It might also have a frangible element, such as a burst disc, that closes its axial passage against fluid pressure from above to enable cement retainer 71 to be pumped down. The burst disc would rupture after the cement retainer latches in profile nipple 21. The launch tube would need to be capable of carrying and launching a following wiper plug in addition to the cement retainer. Additionally, a cement retainer could be run by other means than pumping, such as by a wireline or drill pipe.

Figure 13:
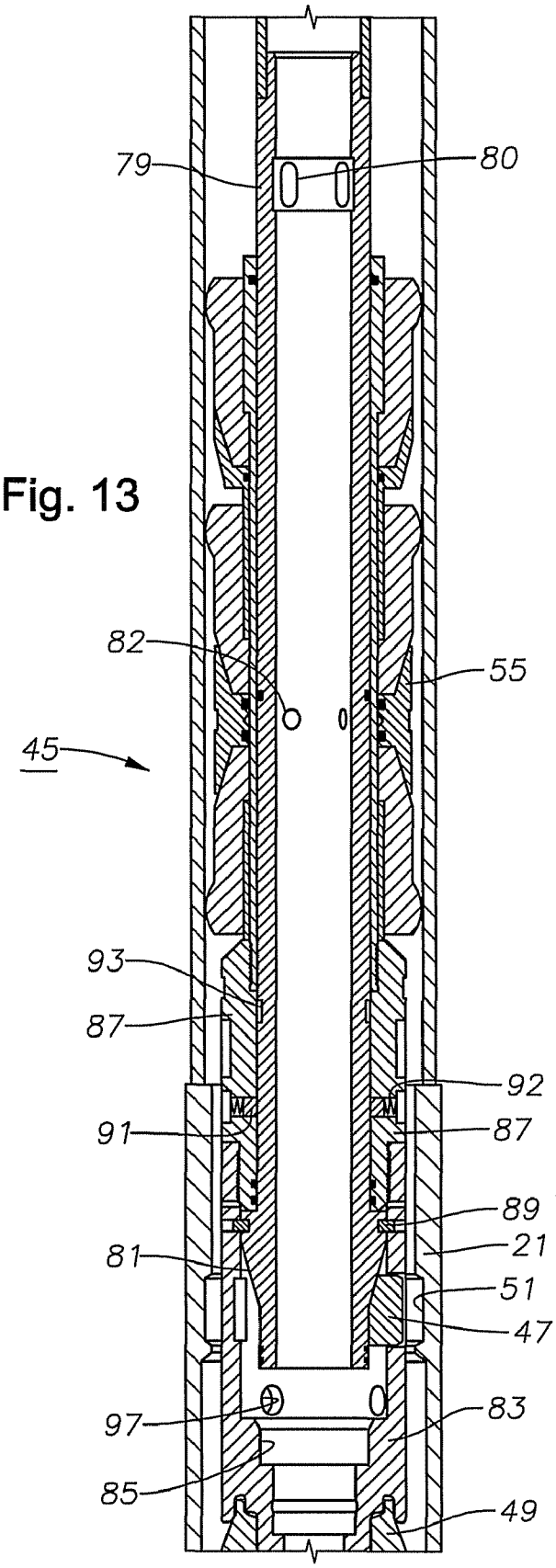
FIG. 13 is an enlarged sectional view of a portion of the drill lock tool of FIG. 11, shown in a run-in position.
Figure 15:
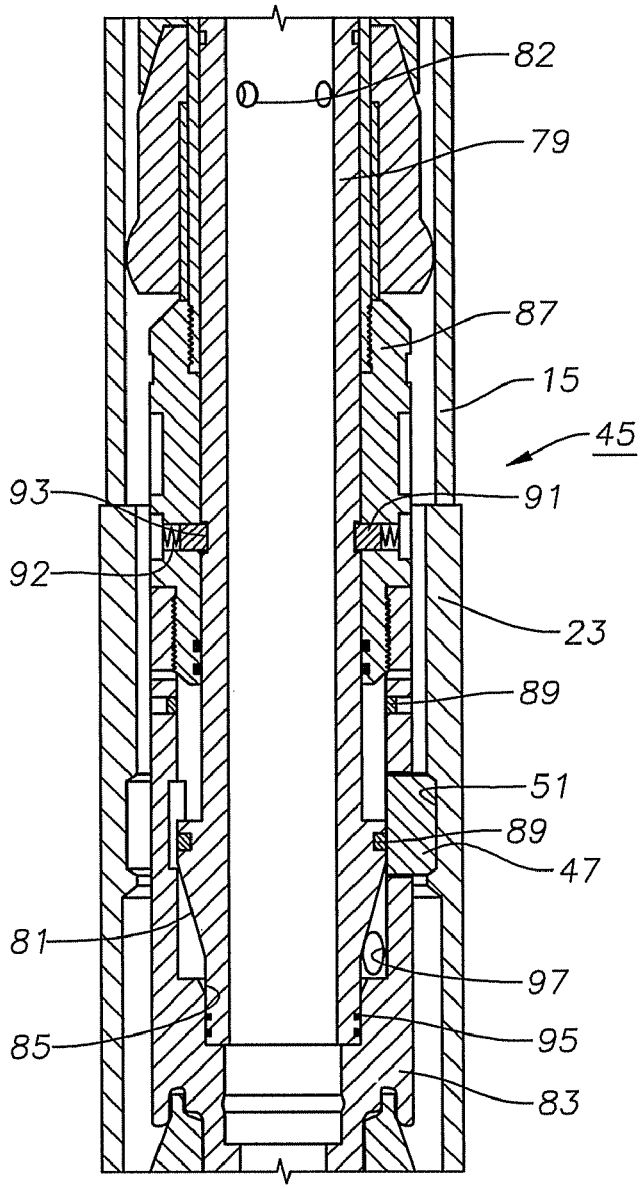
FIG. 15 is an enlarged sectional view of a portion of the drill lock tool of FIG. 11, shown in a set position.
Figure 17:
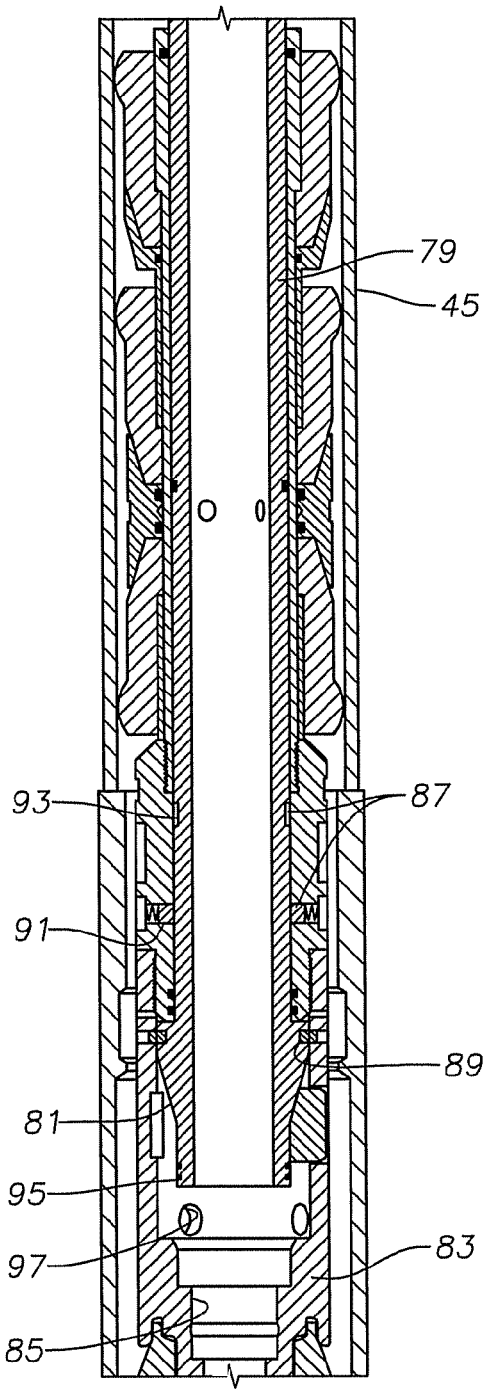
FIG. 17 is a sectional view of the drill lock tool of FIG. 11, shown in a retrieval position.

FIGS. 13, 15 and 17 illustrate one embodiment of drill lock tool 45. Referring to FIG. 13, which shows drill lock tool 45 in a run-in position, drill lock tool 45 includes a cone mandrel 79. Cone mandrel 79 has a conical or tapered ramp 81 that faces downward and outward and is initially located just above axial locks 47. In this example, axial locks 47 comprise a plurality of dogs, each mounted in a window and being capable of moving to an extended position from the contracted position shown in FIG. 13. Cone mandrel 79 in this example is shown extending upward through the section of cup seals 55. If cup seals 55 are employed, cone mandrel 79 optionally might have a bypass sleeve valve 80 and a bypass port 82 to enable bypass around the cup seals at appropriate times.

Figure 11:
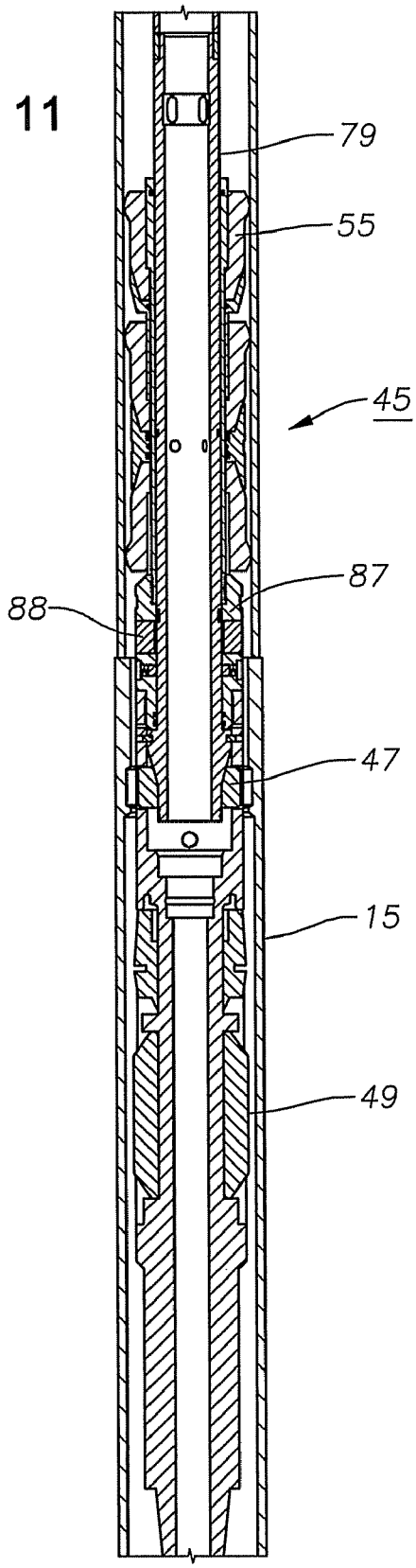
FIG. 11 is a sectional view of a drill lock tool connected into the inner string of FIG. 2B and shown in a run-in position.
Figure 12:
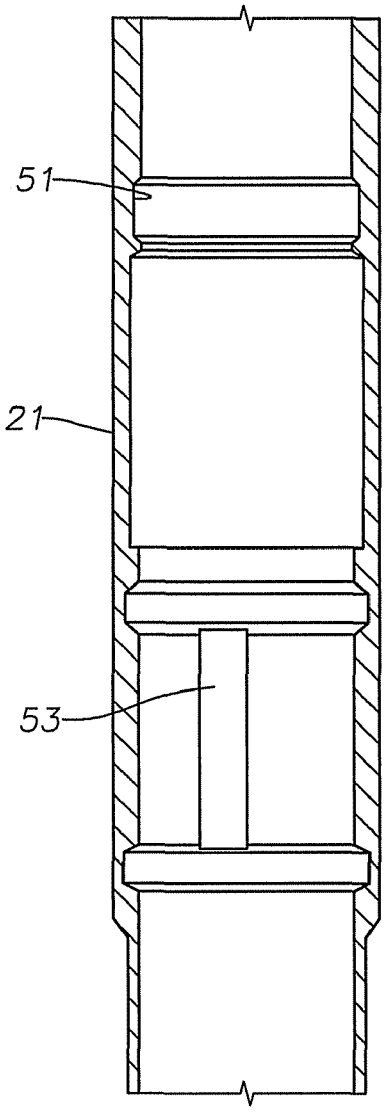
FIG. 12 is a sectional view of a profile nipple connected into the outer string of FIG. 1.

Drill lock tool 45 has a body 83 with a bore 85. The lower portion of cone mandrel 79 is located within bore 85. Cone mandrel 79 may be stroked between an upper position shown in FIG. 13 and a lower position shown in FIG. 15. A retainer nut 87 secures to the upper end of body 83 to limit the upward movement of cone mandrel 79 relative to body 83. Preferably, cone mandrel 79 is not rotatable relative to body 83 because of anti-rotation elements 88, which are shown in the different sectional view of FIG. 11. Anti-rotational elements 88 comprise keys that extend between cone mandrel 79 and retainer nut 87. A plurality of run-in shear fasteners 89 extend between cone mandrel 79 and body 83. During run-in, shear fasteners 89 retain cone mandrel 79 in an upper position relative to axial locks 47. The application of weight at a sufficient level will shear them, enabling cone mandrel 81 to move to the lower position shown in FIG. 15.

In this example, set position shear fasteners 91 are mounted to retainer nut 87. Set fasteners 91 are biased by springs 92 radially inward. In the run-in position, set position shear fasteners 91 simply bear against the outer wall of cone mandrel 79 and do not prevent any movement of cone mandrel 79 relative to body 83. When cone mandrel 79 moves to the set position of FIG. 15, springs 92 will push set position shear fasteners 91 inward into engagement with an annular groove 93 located on cone mandrel 79. In the set position, shear fasteners 91 prevent cone mandrel 91 from moving back upward to the run-in position. For retrieval, the upward force on cone mandrel 79 shears set position shear fasteners 91, as shown in FIG. 17.

Seals 95 are located on a lower cylindrical portion of cone mandrel 79. While in the run-in position of FIG. 13, seals 95 are not engaged and ports 97 extending from bore 85 to the exterior of body 83 are open. While in the set position of FIG. 15, seals 95 engage a counterbore in bore 85, blocking flow through ports 97. Drilling fluid is thus transmitted down the inner passage of cone mandrel 79 to the auxiliary equipment 57 and drill bit 61 (FIG. 2B) located below.

FIG. 17 illustrates drill lock tool 45 after pulled from the set position upward to the retrieval position. To reach the retrieval position, the operator pulls upward on cone mandrel 79 from the set position with a sufficient force to shear set position fasteners 91. This shearing step allows cone mandrel 79 to move upward and frees axial locks 47 to retract inward.

The system described above allows an operator to retrieve a bottom hole assembly during liner drilling without setting the liner string on the bottom of the wellbore. By pulling the upper end of the liner string back to the rig floor, the operator does not need to set and release the liner hanger. The liner hanger and running tool can be conventional since the liner hanger is set only once. The telescoping sub allows the inner string to be axially and rotationally locked to the liner string both at the top and near the bottom. The neutral position of the telescoping sub allows the drilling torque to be transmitted only through the liner string, and not also through the inner string. The upper clutch mechanism enables torque to be transmitted through the telescoping sub during run-in and retrieval from the liner string, if needed. The lower clutch allows one to transmit torque through the telescoping sub while in the contracted position in the event it is needed.

While the invention has been shown in only one of its forms, it should be apparent to those skilled in the art that it is not so limited and is susceptible to various changes without departing from the scope of the invention.

The invention claimed is:

1. A method of drilling a well and installing a liner, comprising:

(a) assembling concentric inner and outer strings of tubulars to define a concentric string assembly, the inner string including a bottom hole assembly axially and rotationally latched to the outer string, the outer string including a string of liner;

(b) connecting a running tool to the liner, and with the running tool, lowering the concentric string assembly into a well from a drilling rig, and rotating a drill bit at a lower end of the bottom hole assembly to deepen the well;

(c) prior to reaching a total depth for the string of liner, raising the concentric string assembly and supporting an upper end of the outer string at the drilling rig with a slip assembly at a rig floor such that the running tool is located above the rig floor;

(d) while the upper end of the outer string is supported at the drilling rig, removing the running tool, then retrieving a remaining portion of the inner string and the bottom hole assembly from the outer string; and (e) re-running the bottom hole assembly on the inner string into the outer string and axially and rotationally re-latching the inner string to the outer string to again define the concentric string assembly, reconnecting the running tool to the liner, lowering the concentric string assembly back into the well, and again rotating the drill bit to deepen the well.

2. The method according to claim 1, wherein:

step (a) comprises connecting a liner hanger to the liner;

step (b) comprises connecting the running tool to the liner hanger;

step (d) comprises removing the liner hanger and the running tool from the liner; and step (e) comprises re-connecting the liner hanger to the liner.

3. The method according to claim 2, wherein when at the total depth for the outer string, setting the hanger to support the weight of the outer string;

retrieving the inner string from the outer string; and cementing the outer string in the well.

4. The method according to claim 2, further comprising:

when at the total depth for the string of liner, setting the hanger to support the weight of the outer string;

retrieving the inner string from the outer string;

on a string of conduit, lowering a packer into cooperative engagement with the hanger and positioning a cement retainer within an upper portion of the outer string;

pumping cement through the string of conduit, the outer string and up an annulus surrounding the outer string;

pumping the cement retainer down the outer string, latching it to a profile in a lower portion of the outer string, and preventing backflow of cement with the cement retainer; and setting the packer and retrieving the string of conduit.

5. The method according to claim 1, wherein rotating the drill bit in step (b) comprises:

rotating an upper end of the inner string to impose torque;

at the upper end of the outer string, transferring the torque from the inner string to the outer string; and near a lower end of the outer string, transferring the torque imposed on the outer string to the bottom hole assembly, leaving the portion of the inner string between the bottom hole assembly and the upper end of the outer string free of torque during drilling.

6. The method according to claim 2, wherein step (a) further comprises:

securing an extension joint into the inner string that has contracted and extended positions that will transmit torque and a neutral position that does not transmit torque;

axially and rotationally locking the inner string to the outer string at a lower point in a lower portion of the outer string; and moving the extension joint to the neutral position between the contracted and extended positions and rotating the liner hanger to secure it to the outer string.

7. The method according to claim 2, wherein:

step (a) further comprises:

securing an extension joint into the inner string that has contracted and extended positions and a neutral position, the extension joint being capable of transferring torque from its upper end to its lower end while in the extended position and incapable of transferring torque from its upper end to its lower end while in the neutral position;

axially and rotationally locking the inner string to the outer string at a lower point near a lower end of the outer string while the extension joint is in the extended position; and moving the extension joint to the neutral position and rotating the liner hanger to secure it to the outer string.

8. The method according to claim 7, wherein the extension joint is in the neutral position while axially and rotationally locking the inner string to the outer string.

9. The method according to claim 2, wherein removing the liner hanger from the liner in step (d) comprises rotating the liner hanger with left-hand rotation relative to the liner.

10. A method of drilling a well and installing a liner, comprising:

(a) suspending a tubular outer string in a well from a drilling rig, the outer string including a string of liner and a liner hanger;

(b) providing a telescoping sub with an engaged and a neutral position, the telescoping sub being capable of transferring to its lower end torque applied to its upper end while in the engaged position, the upper and lower ends of the telescoping sub being free of any torque transmitting engagement while the telescoping sub is in the neutral position;

(c) connecting the telescoping sub into an inner string of tubulars that includes a drill bit;

(d) lowering the inner string into the outer string by connecting additional tubulars to the inner string, and rotationally latching the inner string to the outer string at a lower point in a lower portion of the outer string;

(e) securing a running tool to the liner hanger, placing the telescoping sub in the neutral position and securing the liner hanger to the outer string above the telescoping sub;

(f) while the telescoping sub is in the neutral position, lowering the outer string into the well and performing drilling by rotating an upper portion of the inner string, transferring torque from the inner string to the outer string at the liner hanger and transferring torque from the outer string back to the inner string at the lower point to rotate the drill bit without applying any torque to the inner string between the upper and lower points; and while the inner string is not latched rotationally to the outer string, selectively placing the telescoping sub in the engaged position and rotating the inner string and the drill bit while the outer string remains stationary.

11. The method according to claim 10, wherein:

the telescoping sub has contracted and extended positions; and the telescoping sub is in the engaged position while in the extended position.

12. The method according to claim 11, further comprising:

retrieving the inner string from the outer string, and while doing so, selectively placing the telescoping sub in the extended position and rotating the inner string and the drill bit.

13. The method according to claim 10, wherein steps (d) and (e) further comprise axially locking the inner string to the outer string at the lower point and at the liner hanger.

14. The method according to claim 10, further comprising:

after step (e), raising the inner and outer strings until an upper end of the outer string is at the drilling rig;

with a slip assembly, suspending the upper end of the outer string at the drilling rig with the running tool and the liner hanger above a rig floor, disconnecting the liner hanger from the outer string by left-hand rotation, then retrieving the inner string from the outer string;

re-running the inner string into the outer string; and repeating steps (e) and (f).

15. The method according to claim 10, wherein:

when at a total depth for the outer string, setting the hanger to support the weight of the outer string;

retrieving the inner string from the outer string; and cementing the outer string in the well.

16. The method according to claim 10, wherein:

when at a total depth for the string of liner, setting the hanger to support the weight of the outer string;

retrieving the inner string from the outer string;

on a string of conduit, lowering a packer into cooperative engagement with the hanger and positioning a cement retainer within an upper portion of the outer string;

pumping cement through the string of conduit, the outer string and up an annulus surrounding the outer string;

pumping the cement retainer down the outer string, latching it to a profile in a lower portion of the outer string, and preventing backflow of cement with the cement retainer; and setting the packer and retrieving the string of conduit.

17. An apparatus for drilling and installing a liner, comprising:

a liner string with an upper portion containing a liner hanger and a lower portion containing a profile nipple;

an inner string extending through the liner string, having a drill bit at its lower end;

a drill lock tool mounted to and forming part of the inner string, having a locked position wherein it is axially and rotationally locked to the profile nipple;

a running tool mounted to and forming part of the inner string, having a locked position wherein it is axially and rotationally locked to the liner hanger, which in turn is axially and rotationally locked to the liner string;

a telescoping sub mounted in the inner string between the drill lock tool and the running tool, the telescoping sub being movable between an extended position and a contracted position, the telescoping sub being capable of transmitting torque from its upper end to its lower end while in the extended position, the telescoping sub being incapable of transmitting torque from its upper to its lower end while in a neutral position located between the contracted and extended positions; and wherein the telescoping sub is in the neutral position while the drill lock tool and the running tool are in the locked positions.

18. The method according to claim 17, wherein the telescoping sub is capable of transmitting torque from its upper end to its lower end while in the contracted position.

19. The method according to claim 17, wherein the telescoping sub is mounted in an upper portion of the inner string.

* * * * *